US010584853B2

(12) United States Patent
Kamiya et al.

(10) Patent No.: US 10,584,853 B2
(45) Date of Patent: Mar. 10, 2020

(54) LIGHT-EMITTING DEVICE

(71) Applicant: TOYODA GOSEI CO., LTD., Kiyosu (JP)

(72) Inventors: Masao Kamiya, Kiyosu (JP); Masaaki Osawa, Kiyosu (JP); Satoshi Wada, Kiyosu (JP); Yuhki Kawamura, Kiyosu (JP); Kento Hayashi, Kiyosu (JP)

(73) Assignee: TOYODA GOSEI CO., LTD., Kiyosu-Shi, Aichi-Ken (JP)

( * ) Notice: Subject to any disclaimer, the term of this patent is extended or adjusted under 35 U.S.C. 154(b) by 0 days.

(21) Appl. No.: 16/222,646

(22) Filed: Dec. 17, 2018

(65) Prior Publication Data

US 2019/0285248 A1 Sep. 19, 2019

(30) Foreign Application Priority Data

Mar. 14, 2018 (JP) ..... 2018-046994

(51) Int. Cl.

| | |
|---|---|
| ***F21V 9/30*** | (2018.01) |
| ***F21V 7/22*** | (2018.01) |
| ***F21K 9/64*** | (2016.01) |
| ***F21Y 115/30*** | (2016.01) |

(52) U.S. Cl.

CPC ..... *F21V 9/30* (2018.02); *F21K 9/64* (2016.08); *F21V 7/22* (2013.01); *F21Y 2115/30* (2016.08)

(58) Field of Classification Search

CPC ..... F21K 9/64; F21V 7/22; F21V 9/30; F21Y 2115/30

See application file for complete search history.

(56) References Cited

U.S. PATENT DOCUMENTS

| | | | | |
|---|---|---|---|---|
| 8,564,185 | B2 * | 10/2013 | Ott | F21K 9/64 313/501 |
| 10,330,273 | B2 * | 6/2019 | Gabler | F21S 41/37 |
| 2008/0169752 | A1 | 7/2008 | Hattori et al. | |
| 2014/0153216 | A1 * | 6/2014 | Yamanaka | F21V 5/04 362/84 |
| 2015/0167905 | A1 * | 6/2015 | Khrushchev | F21V 9/30 362/84 |
| 2016/0223891 | A1 * | 8/2016 | Miyata | F21V 14/08 |
| 2018/0038558 | A1 * | 2/2018 | Woisetschlaeger | G02B 26/105 |
| 2018/0112838 | A1 * | 4/2018 | Daniels | F21S 41/285 |

FOREIGN PATENT DOCUMENTS

| | | | |
|---|---|---|---|
| JP | 4264109 | B2 | 5/2009 |
| JP | 2012-054272 | A | 3/2012 |

* cited by examiner

*Primary Examiner* — Peggy A Neils

(74) *Attorney, Agent, or Firm* — McGinn I.P. Law Group, PLLC.

(57) ABSTRACT

A light-emitting device includes a plurality of semiconductor laser elements including a first semiconductor laser element, and a plurality of reflectors including a first reflector for reflecting light emitted from the first semiconductor laser element, each of reflectors reflecting light emitted from corresponding one of the plurality of semiconductor laser elements. Light emitted from the first semiconductor laser element passes through a gap between two of the plurality of reflectors excluding the first reflector and reaches the first reflector. Lights emitted from the plurality of semiconductor laser elements are extracted in a direction different than an incident direction thereof toward the plurality of reflectors.

5 Claims, 6 Drawing Sheets

30a WAVELENGTH-CONVERTING MEMBER
33a WAVELENGTH-SELECTIVE REFLECTOR

LIGHT-EMITTING DEVICE

The present application is based on Japanese patent application No. 2018-046994 filed on Mar. 14, 2018, the entire contents of which are incorporated herein by reference.

BACKGROUND OF THE INVENTION

1. Field of the Invention

The invention relates to a light-emitting device.

2. Related Art

A light-emitting device is known in which plural semiconductor laser elements (laser diodes) emit light onto a single phosphor from different directions in a horizontal plane and light is extracted vertically upward (see, e.g., JP 2012/54272 A). JP 2012/54272 A indicates that the light-emitting device can be configured to obtain a high output while also being downsized.

Another light-emitting device is known which is provided with a semiconductor laser element, a semitransparent film which is arranged to face the semiconductor laser element and transmits excitation light emitted from the light-emitting element, a light-emitting film containing a phosphor which absorbs the excitation light transmitted through the semitransparent film and emits visible output light with a different wavelength from that of the excitation light, and a reflective film which is arranged on the opposite side to the semitransparent film with respect to the light-emitting film and reflects at least the excitation light toward the light-emitting film (see, e.g., JP 4264109 B). JP 4264109 B indicates that the light-emitting device can be configured to prevent the leakage of excitation light emitted from the semiconductor laser element.

SUMMARY OF THE INVENTION

The light-emitting device of JP 2012/54272 A may have a problem that light emitted from the semiconductor laser element and inputted to the phosphor leaks toward the side opposite to the semiconductor laser element. The light leaking from the phosphor to the side opposite to the semiconductor laser element may be absorbed by members of the light-emitting device, such as other semiconductor laser elements, and cannot be extracted to the outside, causing a decrease in light extraction efficiency.

The light-emitting device of JP 4264109 B may prevent the leakage of the excitation light emitted from the semiconductor laser element to suppress a decrease of light extraction efficiency. However, when plural semiconductor laser elements are mounted for obtaining a high output, it may be difficult to concentrate light in a very small region since the positions of the semitransparent film, the light-emitting film and the reflective film relative to the semiconductor laser elements are limited.

It is an object of the invention to provide a light-emitting device that is high in light extraction efficiency and is configured such that, where plural semiconductor laser elements are provided therein for obtaining a high output, light emitted from the semiconductor laser elements can be concentrated in a very small region.

According to an embodiment of the invention, a light-emitting device defined by [1] to [8] below can be provided.

[1] A light-emitting device, comprising:

a plurality of semiconductor laser elements including a first semiconductor laser element; and a plurality of reflectors including a first reflector for reflecting light emitted from the first semiconductor laser element, each of reflectors reflecting light emitted from corresponding one of the plurality of semiconductor laser elements, wherein light emitted from the first semiconductor laser element passes through a gap between two of the plurality of reflectors excluding the first reflector and reaches the first reflector, and wherein lights emitted from the plurality of semiconductor laser elements are extracted in a direction different than an incident direction thereof toward the plurality of reflectors.

[2] The light-emitting device according to [1], further comprising a plurality of scattering materials that are each arranged in a region between one of the plurality of semiconductor laser elements and corresponding one of the plurality of reflectors.

[3] The light-emitting device according to [2], wherein the plurality of scattering materials are integrated into a single scattering material.

[4] The light-emitting device according to [2] or [3], wherein each of the plurality of scattering materials comprises a wavelength-converting member.

[5] The light-emitting device according to [4], wherein an arbitrary one of the plurality of semiconductor laser elements is defined as a predetermined semiconductor laser element, one of the plurality of reflectors that reflects light emitted from the predetermined semiconductor laser element is defined as a predetermined reflector, and one of the plurality of scattering materials that is arranged between the predetermined semiconductor laser element and the predetermined reflector is defined as a predetermined scattering material, and wherein a wavelength-selective reflector that transmits light emitted from the predetermined semiconductor laser element and reflects light wavelength-converted by the predetermined scattering material is arranged between the predetermined semiconductor laser element and the predetermined scattering material, and between the predetermined reflector and the predetermined scattering material.

[6] The light-emitting device according to any one of [1] to [5], wherein incident directions of lights emitted from the plurality of semiconductor laser elements toward the plurality of reflectors are parallel to each other.

[7] The light-emitting device according to any one of [1] to [4], wherein an arbitrary one of the plurality of semiconductor laser elements is defined as a predetermined semiconductor laser element, and one of the plurality of reflectors that reflects light emitted from the predetermined semiconductor laser element is defined as a predetermined reflector, and wherein light emitted from the predetermined semiconductor laser element passes through a gap between two of the plurality of reflectors excluding the predetermined reflector and reaches the predetermined reflector.

[8] The light-emitting device according to any one of [1] to [4] and [7], wherein not less than two of the plurality of reflectors are integrated into a single reflector.

Effects of the Invention

According to an embodiment of the invention, a light-emitting device can be provided that is high in light extraction efficiency and is configured such that, where plural semiconductor laser elements are provided therein for obtaining a high output, light emitted from the semiconductor laser elements can be concentrated in a very small region.

BRIEF DESCRIPTION OF THE DRAWINGS

Next, the present invention will be explained in more detail in conjunction with appended drawings, wherein.

DESCRIPTION OF THE PREFERRED EMBODIMENTS

First Embodiment

Configuration of Light-Emitting Device

Figure 1A:
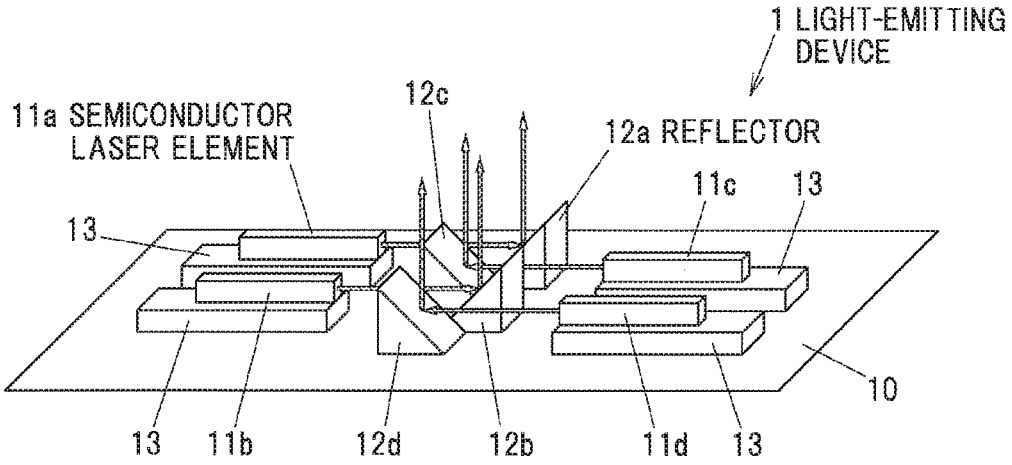
FIGS. 1A and 1B are a perspective view and a top view showing a light-emitting device in the first embodiment.
Figure 1B:
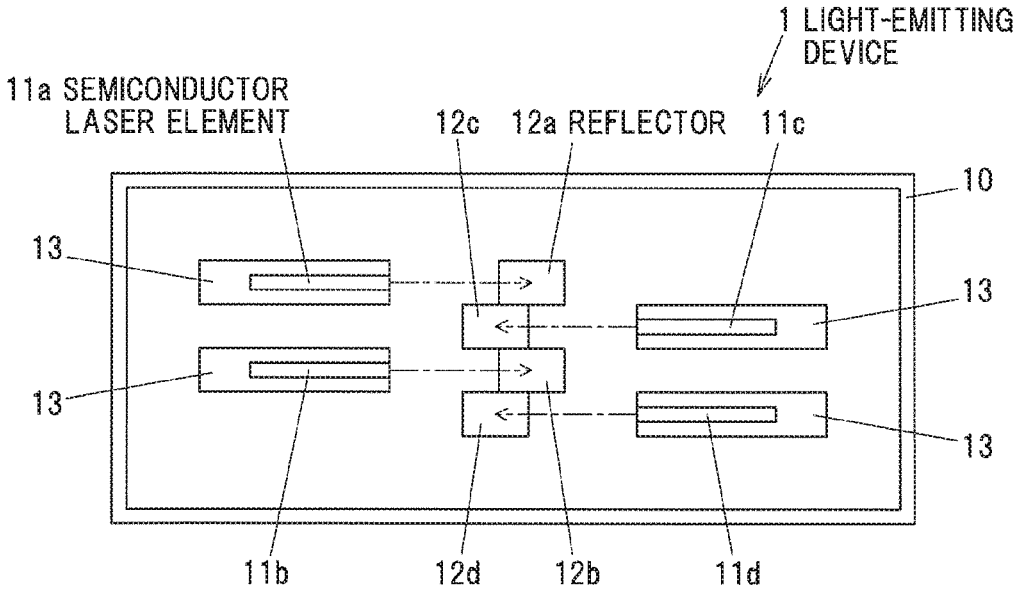

FIGS. 1A and 1B are a perspective view and a top view showing a light-emitting device 1 in the first embodiment. The light-emitting device 1 is provided with plural semiconductor laser elements 11 (11*a* to 11*d*), and plural reflectors 12 (12*a* to 12*d*) each of which reflects light emitted from the corresponding one of the plural semiconductor laser elements 11.

The plural semiconductor laser elements 11 and the plural reflectors 12 are housed in a case 10. The shape and material of the case 10 are not specifically limited. In FIGS. 1A and 1B, the configuration inside the case 10 is shown and a portion of the case 10 is omitted.

In the light-emitting device 1, the directions of incidence of light emitted from the plural semiconductor laser elements 11 on the plural reflectors 12 are horizontal (directions parallel to the bottom surface of the case 10) and a light extraction direction is vertically upward (a direction vertically away from the bottom surface of the case 10). That is, the light-emitting device 1 is configured that light is extracted in a direction different from the directions of incidence of light emitted from the plural semiconductor laser elements 11 on the plural reflectors 12.

In the light-emitting device 1, substantially all the light emitted from the plural semiconductor laser elements 11 is reflected by the plural reflectors 12 and extracted. Thus, leakage of light is very little, allowing the light-emitting device 1 to have high light extraction efficiency.

In the light-emitting device 1, light emitted from the semiconductor laser element lib passes between the reflectors 12*c* and 12*d* and reaches the reflector 12*b*. Likewise, light emitted from the semiconductor laser element 11*c* passes between the reflectors 12*a* and 12*b* and reaches the reflector 12*c*.

As such, it is possible to concentrate light emitted from the plural semiconductor laser elements 11 in a very small region by arranging the plural semiconductor laser elements 11 and the plural reflectors 12 so that light emitted from at least one semiconductor laser element 11 reaches the corresponding reflector 12 through a space between two reflectors 12 reflecting light emitted from other semiconductor laser elements 11.

In the light-emitting device 1, the direction of incidence of light emitted from the semiconductor laser element 11*a* on the reflector 12*a*, the direction of incidence of light emitted from the semiconductor laser element lib on the reflector 12*b*, the direction of incidence of light emitted from the semiconductor laser element 11*c* on the reflector 12*c* and the direction of incidence of light emitted from the semiconductor laser element 11*d* on the reflector 12*d* are substantially parallel. In other words, the directions of incidence of light emitted from the plural semiconductor laser elements 11 on the plural reflectors 12 are substantially parallel to each other.

The semiconductor laser elements 11 are light sources of the light-emitting device 1 and also serve as excitation light sources for wavelength-converting members when the wavelength-converting members are arranged in the light-emitting device 1. The semiconductor laser elements 11 in a state of being arranged on bases 13 are housed in the case 10.

The emission wavelength of the semiconductor laser element 11 is not specifically limited and is appropriately selected according to emission color, etc., of the light-emitting device 1. When the light-emitting device 1 has, e.g., wavelength-converting members emitting yellow fluorescence, use of the semiconductor laser elements 11 emitting blue light allows the light-emitting device 1 to produce white light as a mixture of yellow fluorescence and a portion of blue light extracted without being wavelength-converted by the wavelength-converting members.

The reflector 12 is a mirror which has a reflective surface inclined with respect to a horizontal plane. The inclination angle of the reflective surface of the reflector 12 is appropriately determined according to an angle of incidence of light emitted from the semiconductor laser element 11 and a light extraction direction, and light can be emitted, e.g., vertically upward by reflecting light horizontally emitted from the semiconductor laser element 11 at the reflective surface of the reflector 12 which is inclined 45 degrees from the horizontal plane.

The light-emitting device 1 may be configured that wavelength-converting members containing a phosphor are provided above the reflectors 12. In this case, light reflected by the reflectors 12 and traveling upward is absorbed by the wavelength-converting members which thereby emit fluorescence.

Figure 2A:
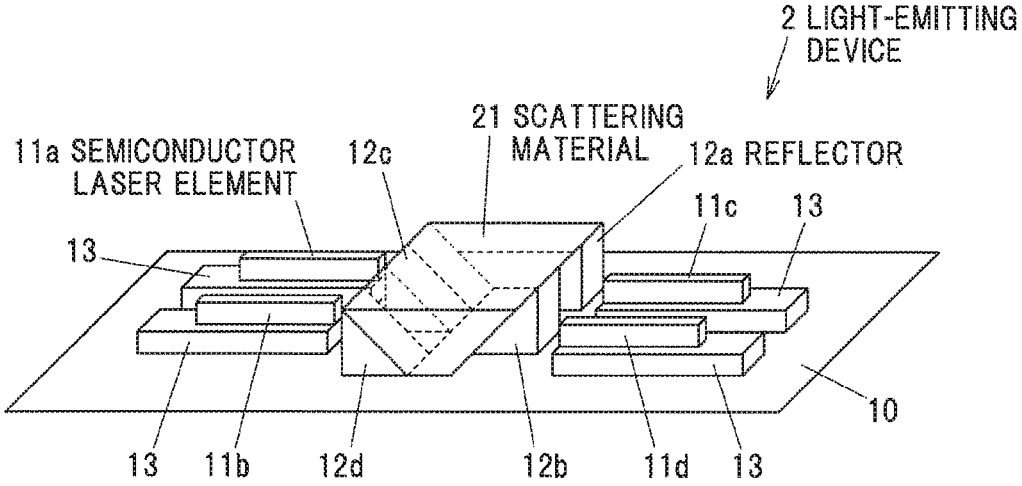
FIGS. 2A and 2B are a perspective view and a top view showing a modification of the light-emitting device in the first embodiment.
Figure 2B:
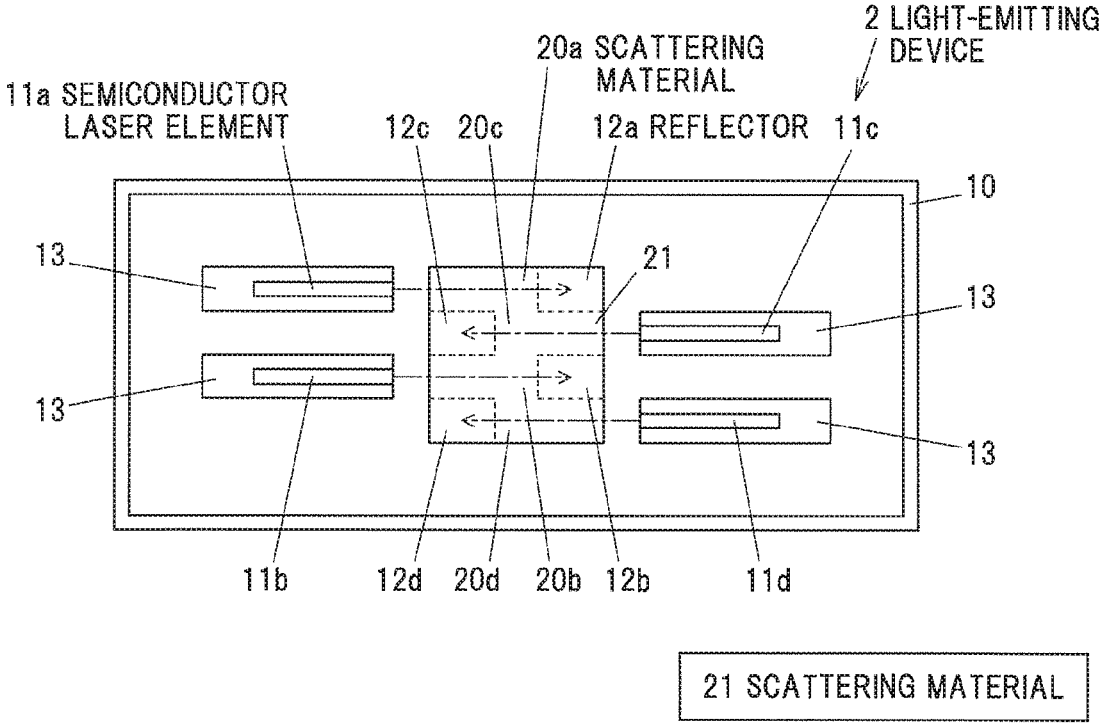

FIGS. 2A and 2B are a perspective view and a top view showing a light-emitting device 2 which is a modification of the light-emitting device 1 in the first embodiment.

The light-emitting device 2 is provided with plural scattering materials 20 (20*a* to 20*d*) each of which is arranged between one of the semiconductor laser elements 11 and the corresponding one of the reflectors 12. The scattering material 20*a* is arranged between the semiconductor laser element 11*a* and the reflector 12*a*, the scattering material 20*b* is arranged between the semiconductor laser element 11*b* and the reflector 12*b*, the scattering material 20*c* is arranged between the semiconductor laser element 11*c* and the reflector 12*c*, and the scattering material 20*d* is arranged between the semiconductor laser element 11*d* and the reflector 12*d*.

The plural scattering materials 20 are members in which, e.g., a scattering agent such as titanium dioxide ($TiO_2$) is dispersed in a base material formed of translucent alumina, glass or resin, etc.

The plural scattering materials 20 may be wavelength-converting members containing a phosphor. In this case, the scattering materials 20 are, e.g., members containing phosphor particles in a base material formed of translucent alumina, glass or resin, etc., or sintered phosphors.

The phosphor contained in the plural scattering materials 20 is not specifically limited and may be, e.g., a yellow phosphor such as YAG (Yttrium aluminum garnet) phosphor, α-SiAlON phosphor or BOS (Barium orthosilicate) phosphor, or may be a mixture of a green phosphor such as β-SiAlON phosphor and a red phosphor such as $(Ca,Sr)_2Si_5N_8$:Eu or $CaAlSiN_3$:Eu.

The scattering materials 20*a*, 20*b*, 20*c* and 20*d* may be provided as separate members, but preferably constitute a single continuous scattering material 21 as shown in FIGS. 2A and 2B.

The shape of the plural scattering materials 20 is not specifically limited. In the example shown in FIGS. 2A and 2B, the scattering material 21 composed of the scattering materials 20*a*, 20*b*, 20*c* and 20*d* has a shape of horizontally-laid trapezoid-based prism having side surfaces of which inclination matches the inclination of the reflective surfaces of the plural reflectors 12.

Light emitted from the plural semiconductor laser elements 11 enters the plural scattering materials 20 and is scattered inside the plural scattering materials 20. Then, light coming out through a surface on the opposite side to the incidence surface is reflected upward by the plural reflectors 12. Thus, leakage of light is very little, allowing the light-emitting device 2 to have high light extraction efficiency.

In case that the plural scattering materials 20 are wavelength-converting members, light which entered the plural scattering materials 20 is partially or substantially completely absorbed by the plural scattering materials 20 which thereby emit fluorescence. When, e.g., the semiconductor laser elements 11 emit blue light and the plural scattering materials 20 exhibit yellow fluorescence, light which can be extracted from the light-emitting device 2 is white light as a mixture of yellow fluorescence and a portion of blue light extracted without being wavelength-converted by the plural scattering materials 20.

In case that the plural scattering materials 20 are wavelength-converting members, wavelength-selective reflectors which transmit light emitted from the plural semiconductor laser elements 11 and reflect light wavelength-converted by the plural scattering materials 20, such as DBR (Distributed Bragg Reflector) films, may be additionally provided on the incidence surfaces of the plural scattering materials 20 on which light emitted from the semiconductor laser elements 11 is incident.

Second Embodiment

The second embodiment is different from the first embodiment in a mechanism to extract light emitted from the semiconductor laser elements. The same members as those in the first embodiment are denoted by the same reference numerals and the explanation thereof will be omitted or simplified. In addition, the explanation of the same features as those in the first embodiment, such as the functions and effects, etc., of the same types of members, will be omitted or simplified.

Configuration of Light-Emitting Device

Figure 3A:
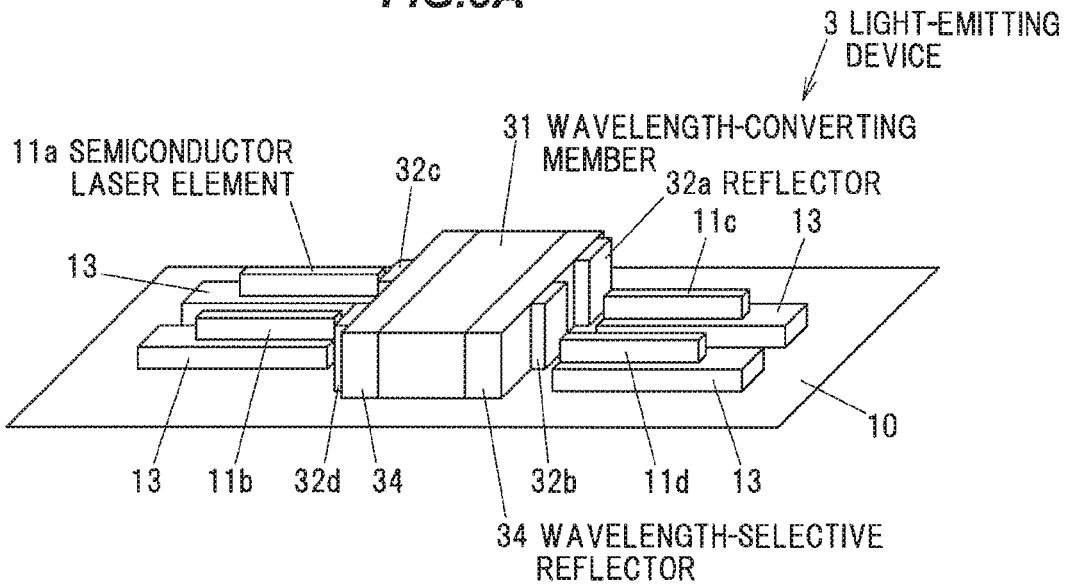
FIGS. 3A and 3B are a perspective view and a top view showing a light-emitting device in the second embodiment.
Figure 3B:
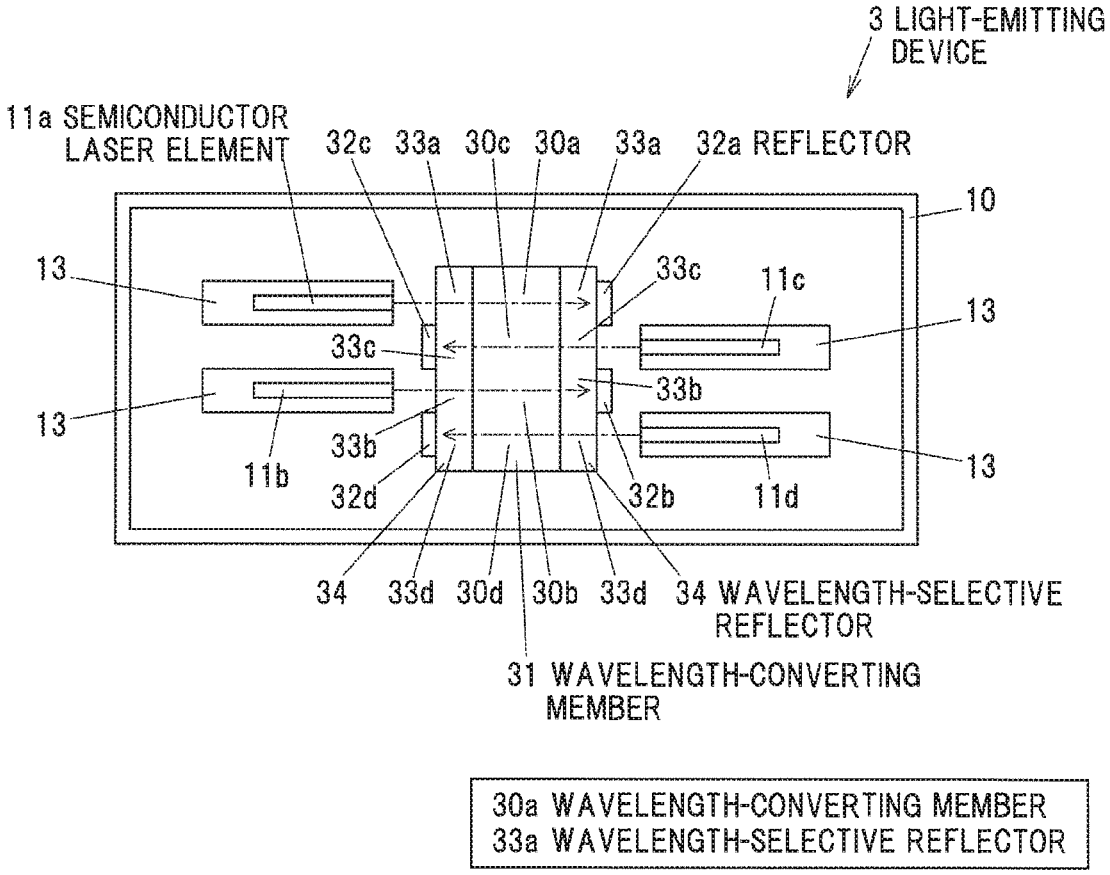

FIGS. 3A and 3B are a perspective view and a top view showing a light-emitting device 3 in the second embodiment. The light-emitting device 3 is provided with the plural semiconductor laser elements 11 (11*a* to 11*d*), plural reflectors 32 (32*a* to 32*d*) each of which reflects light emitted from the corresponding one of the plural semiconductor laser elements 11, plural wavelength-converting members 30 (30*a* to 30*d*) each of which is arranged between one of the semiconductor laser elements 11 and the corresponding one of the reflectors 32, and plural wavelength-selective reflectors 33 (33*a* to 33*d*) which are arranged between the plural semiconductor laser elements 11 and the plural wavelength-converting members 30 and between the plural reflectors 32 and the plural wavelength-converting members 30, transmit light emitted from the plural semiconductor laser elements 11 and reflect light wavelength-converted by the plural wavelength-converting members 30.

In the light-emitting device 3, light emitted from the plural semiconductor laser elements 11 and wavelength-converted by the plural wavelength-converting members 30 is reflected by the wavelength-selective reflectors 33 arranged to sandwich the plural wavelength-converting members 30 and is thus mostly emitted upward. Meanwhile, light emitted from the plural semiconductor laser elements 11 and coming out from the plural wavelength-converting members 30 without wavelength conversion is reflected by the plural reflectors 32 and is emitted upward. Thus, leakage of light is very little, allowing the light-emitting device 3 to have high light extraction efficiency.

In the light-emitting device 3, light emitted from the semiconductor laser element 11*b* passes between the reflectors 32*c* and 32*d* and reaches the reflector 32*b*. Likewise, light emitted from the semiconductor laser element 11*c* passes between the reflectors 32*a* and 32*b* and reaches the reflector 32*c*.

As such, it is possible to concentrate light emitted from the plural semiconductor laser elements 11 in a very small region by arranging the plural semiconductor laser elements 11 and the plural reflectors 32 so that light emitted from at least one semiconductor laser element 11 reaches the corresponding reflector 32 through a space between two reflectors 32 reflecting light emitted from other semiconductor laser elements 11.

In the light-emitting device 3, the direction of incidence of light emitted from the semiconductor laser element 11*a* on the reflector 32*a*, the direction of incidence of light emitted from the semiconductor laser element 11*b* on the reflector 32*b*, the direction of incidence of light emitted from the semiconductor laser element 11*c* on the reflector 32*c* and the direction of incidence of light emitted from the semiconductor laser element 11*d* on the reflector 32*d* are substantially parallel. In other words, the directions of incidence of light emitted from the plural semiconductor laser elements 11 on the plural reflectors 32 are substantially parallel to each other.

The reflectors 32 are, e.g., films formed of a resin containing a reflective filler and are formed on side surfaces of the wavelength-selective reflectors 33. A silicon-based resin or an epoxy-based resin, etc., can be used as the resin constituting the reflectors 32. Particles of a highly reflective material such as $TiO_2$, $BaSO_4$, ZnO, $BaCO_3$ or $SiO_2$ can be used as the reflective filler.

The wavelength-converting member 30*a* is arranged between the semiconductor laser element 11*a* and the reflector 32*a*, the wavelength-converting member 30*b* is arranged between the semiconductor laser element 11*b* and the reflector 32*b*, the wavelength-converting member 30*c* is arranged between the semiconductor laser element 11*c* and the reflector 32*c*, and the wavelength-converting member 30*d* is arranged between the semiconductor laser element 11*d* and the reflector 32*d*.

The plural wavelength-converting members 30 are formed of the same materials as the wavelength-converting members used as the scattering materials 20 in the first embodiment.

The wavelength-converting members 30*a*, 30*b*, 30*c* and 30*d* may be provided as separate members, but preferably constitute a single continuous wavelength-converting member 31 as shown in FIGS. 3A and 3B.

The shape of the plural wavelength-converting members 30 is not specifically limited. In the example shown in FIGS. 3A and 3B, the wavelength-converting member 31 composed of the wavelength-converting members 30*a*, 30*b*, 30*c* and 30*d* has a rectangular parallelepiped shape of which side surfaces face the plural semiconductor laser elements 11.

Light which entered the plural wavelength-converting members 30 is partially or substantially completely absorbed by the plural wavelength-converting members 30 which thereby emit fluorescence. When, e.g., the semiconductor laser elements 11 emit blue light and the plural wavelength-converting members 30 exhibit yellow fluorescence, light which can be extracted from the light-emitting device 3 is white light as a mixture of yellow fluorescence and a portion of blue light extracted without being wavelength-converted by the plural wavelength-converting members 30.

The wavelength-selective reflectors 33*a* are arranged between the semiconductor laser element 11*a* and the wavelength-converting member 30*a* and between the reflector 32*a* and the wavelength-converting member 30*a*. The wavelength-selective reflectors 33*b* are arranged between the semiconductor laser element lib and the wavelength-converting member 30*b* and between the reflector 32*b* and the wavelength-converting member 30*b*. The wavelength-selective reflectors 33*c* are arranged between the semiconductor laser element 11*c* and the wavelength-converting member 30*c* and between the reflector 32*c* and the wavelength-converting member 30*c*. The wavelength-selective reflectors 33*d* are arranged between the semiconductor laser element 11*d* and the wavelength-converting member 30*d* and between the reflector 32*d* and the wavelength-converting member 30*d*.

The plural wavelength-selective reflectors 33 are, e.g., DBR films.

The wavelength-selective reflector 33*a*, the wavelength-selective reflector 33*b*, the wavelength-selective reflector 33*c* and the wavelength-selective reflector 33*d* may be provided as separate members, but preferably constitute a single continuous wavelength-selective reflector 34 as shown in FIGS. 3A and 3B.

The shape of the plural wavelength-selective reflectors 33 is not specifically limited. In the example shown in FIGS. 3A and 3B, each wavelength-selective reflector 34 composed of the wavelength-selective reflector 33*a*, the wavelength-selective reflector 33*b*, the wavelength-selective reflector 33*c* and the wavelength-selective reflector 33*d* has a rectangular parallelepiped shape which covers a side surface of the rectangular parallelepiped-shaped wavelength-converting member 31.

Third Embodiment

The third embodiment is different from the first embodiment in arrangement of the semiconductor laser elements, etc. The same members as those in the other embodiments are denoted by the same reference numerals and the explanation thereof will be omitted or simplified. In addition, the explanation of the same features as those in the other embodiments, such as the functions and effects, etc., of the same types of members, will be omitted or simplified.

Configuration of Light-Emitting Device

Figure 4A:
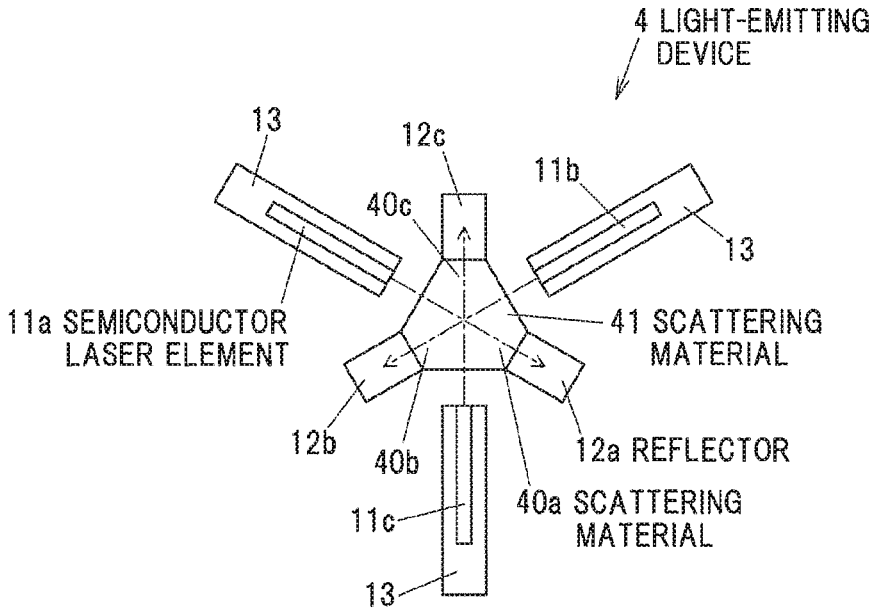
FIGS. 4A and 4B are top views showing internal configurations of light-emitting devices in the third embodiment.
Figure 4B:
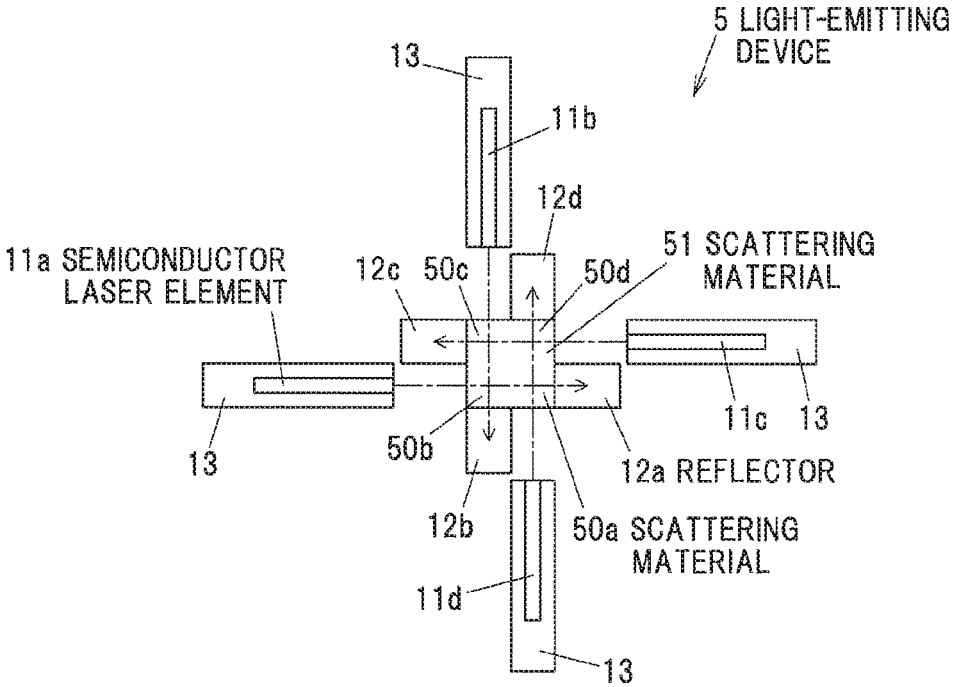

FIGS. 4A and 4B are top views showing internal configurations of light-emitting devices 4 and 5 in the third embodiment.

The light-emitting device 4 is provided with the plural semiconductor laser elements 11 (11*a* to 11*c*), the plural reflectors 12 (12*a* to 12*c*) each of which reflects light emitted from the corresponding one of the plural semiconductor laser elements 11, and plural scattering materials 40 (40*a* to 40*c*) each of which is arranged between one of the semiconductor laser elements 11 and the corresponding one of the reflectors 12.

The light-emitting device 5 is provided with the plural semiconductor laser elements 11 (11*a* to 11*d*), the plural reflectors 12 (12*a* to 12*d*) each of which reflects light emitted from the corresponding one of the plural semiconductor laser elements 11, and plural scattering materials 50 (50*a* to 50*d*) each of which is arranged between one of the semiconductor laser elements 11 and the corresponding one of the reflectors 12.

In the light-emitting devices 4 and 5, light emitted from the plural semiconductor laser elements 11 enters the plural scattering materials 40, 50 and is scattered inside the plural scattering materials 40, 50. Then, light coming out through surfaces on the opposite side to the incidence surfaces is reflected upward by the plural reflectors 12. Thus, leakage of light is very little, allowing the light-emitting devices 4 and 5 to have high light extraction efficiency.

In the light-emitting device 4, light emitted from the semiconductor laser element 11*a* passes between the reflectors 12*b* and 12*c* and reaches the reflector 12*a*. Likewise, light emitted from the semiconductor laser element 11*b* passes between the reflectors 12*a* and 12*c* and reaches the reflector 12*b*. Then, light emitted from the semiconductor laser element 11*c* passes between the reflectors 12*a* and 12*b* and reaches the reflector 12*c*.

Meanwhile, in the light-emitting device 5, light emitted from the semiconductor laser element 11*a* passes between the reflector 12*b* and the reflectors 12*c*, 12*d* and reaches the reflector 12*a*. Likewise, light emitted from the semiconductor laser element 11*b* passes between the reflector 12*c* and the reflectors 12*a*, 12*d* and reaches the reflector 12*b*. Then, light emitted from the semiconductor laser element 11*c* passes between the reflector 12*d* and the reflectors 12*a*, 12*b* and reaches the reflector 12*c*. Then, light emitted from the semiconductor laser element 11*d* passes between the reflector 12*a* and the reflectors 12*b*, 12*c* and reaches the reflector 12*d*.

As such, it is possible to concentrate light emitted from the plural semiconductor laser elements 11 in a very small region by arranging the plural semiconductor laser elements 11 and the plural reflectors 12 so that light emitted from an arbitrary one of the plural semiconductor laser elements 11 reaches the corresponding reflector 12 through a space between two reflectors 12 reflecting light emitted from other semiconductor laser elements 11.

In the light-emitting device 4, the relative angles between the direction of incidence of light emitted from the semiconductor laser element 11*a* on the reflector 12*a*, the direction of incidence of light emitted from the semiconductor laser element 11*b* on the reflector 12*b*, and the direction of incidence of light emitted from the semiconductor laser element 11*c* on the reflector 12*c* are substantially equal to the relative angles between the directions of three straight lines each running from a vertex to the center point in an equilateral triangle.

In the light-emitting device 5, the relative angles between the direction of incidence of light emitted from the semiconductor laser element 11*a* on the reflector 12*a*, the direction of incidence of light emitted from the semiconductor laser element 11*b* on the reflector 12*b*, the direction of incidence of light emitted from the semiconductor laser element 11*c* on the reflector 12*c*, and the direction of incidence of light emitted from the semiconductor laser element 11*d* on the reflector 12*d* are substantially equal to the relative angles between the directions of four straight lines each running from a corner to the center point in a square.

In the light-emitting device 4, the scattering material 40*a* is arranged between the semiconductor laser element 11*a* and the reflector 12*a*, the scattering material 40*b* is arranged between the semiconductor laser element 11*b* and the reflector 12*b*, and the scattering material 40*c* is arranged between the semiconductor laser element 11*c* and the reflector 12*c*.

In the light-emitting device 5, the scattering material 50*a* is arranged between the semiconductor laser element 11*a* and the reflector 12*a*, the scattering material 50*b* is arranged between the semiconductor laser element 11*b* and the reflector 12*b*, the scattering material 50*c* is arranged between the semiconductor laser element 11*c* and the reflector 12*c*, and the scattering material 50*d* is arranged between the semiconductor laser element 11*d* and the reflector 12*d*.

The plural scattering materials 40, 50 are formed of the same materials as the plural scattering materials 20 in the first embodiment. Alternatively, the plural scattering materials 40, 50 may be wavelength-converting members containing a phosphor. In this case, the plural scattering materials 40, 50 are formed of the same materials as the wavelength-converting members used as the scattering materials 20 in the first embodiment.

In case that the plural scattering materials 40, 50 are wavelength-converting members, wavelength-selective reflectors which transmit light emitted from the plural semiconductor laser elements 11 and reflect light wavelength-converted by the plural scattering materials 40, 50, such as DBR films, may be additionally provided on the incidence surfaces of the plural scattering materials 40, 50 on which light emitted from the semiconductor laser elements 11 is incident.

The scattering materials 40*a*, 40*b* and 40*c* may be provided as separate members, but preferably constitute a single continuous scattering material 41 as shown in FIG. 4A. Likewise, the scattering materials 50*a*, 50*b*, 50*c* and 50*d* may be provided as separate members, but preferably constitute a single continuous scattering material 51 as shown in FIG. 4B.

The shape of the plural scattering materials 40, 50 is not specifically limited. In the example shown in FIG. 4A, the scattering material 41 composed of the scattering materials 40*a*, 40*b* and 40*c* has a hexagonal prism shape which can fit into a region surrounded by the reflectors 12*a* to 12*c*. Likewise, in the example shown in FIG. 4B, the scattering material 51 composed of the scattering materials 50*a*, 50*b*, 50*c* and 50*d* has a square prism shape which can fit into a region surrounded by the reflectors 12*a* to 12*d*.

The scattering materials 40*a*, 40*b* and 40*c*, if not required, may not be provided in the light-emitting device 4. Likewise, the scattering materials 50*a*, 50*b*, 50*c* and 50*d*, if not required, may not be provided in the light-emitting device 5.

When the scattering materials 40*a*, 40*b* and 40*c*, or the scattering materials 50*a*, 50*b*, 50*c* and 50*d*, are wavelength-converting members, a reflection structure composed of the plural reflectors 32 and the plural wavelength-selective reflectors 33 in the second embodiment may be used in place of the plural reflectors 12. In this case, the positions of the plural reflectors 32 are the same as those of the plural reflectors 12, and the plural wavelength-selective reflectors 33 are positioned in the same manner as in the second embodiment.

Fourth Embodiment

The fourth embodiment is different from the other embodiments in that one reflector reflect light emitted from plural semiconductor laser elements. The same members as those in the other embodiments are denoted by the same reference numerals and the explanation thereof will be omitted or simplified. In addition, the explanation of the same features as those in the other embodiments, such as the functions and effects, etc., of the same types of members, will be omitted or simplified.

Configuration of Light-Emitting Device

Figure 5A:
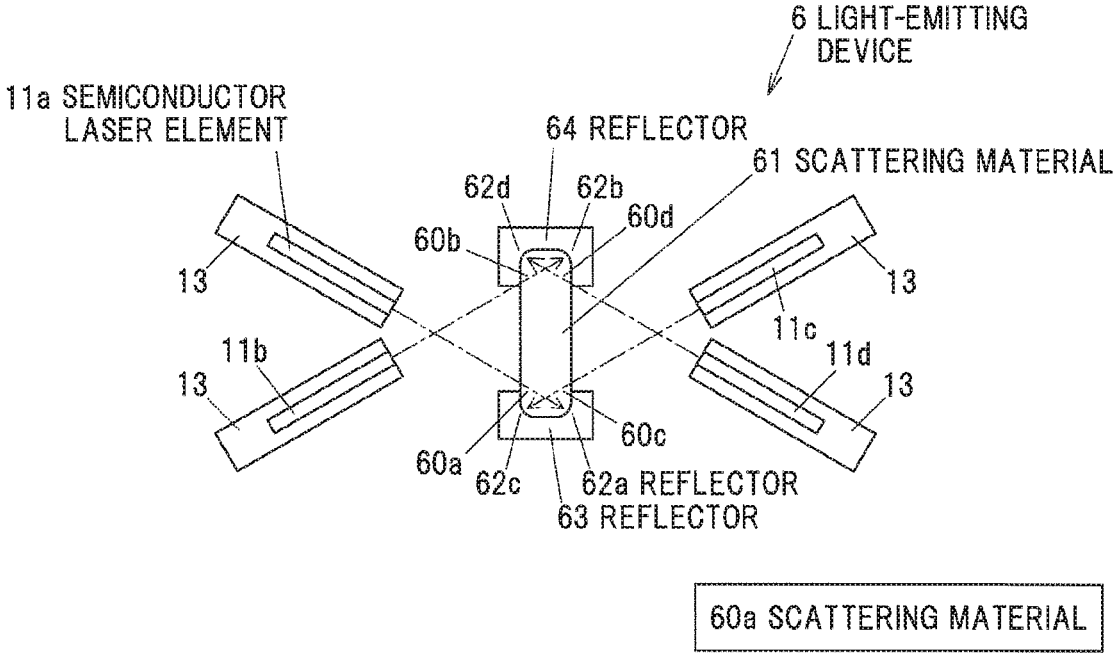
FIGS. 5A and 5B are top views showing internal configurations of light-emitting devices in the fourth embodiment.
Figure 5B:
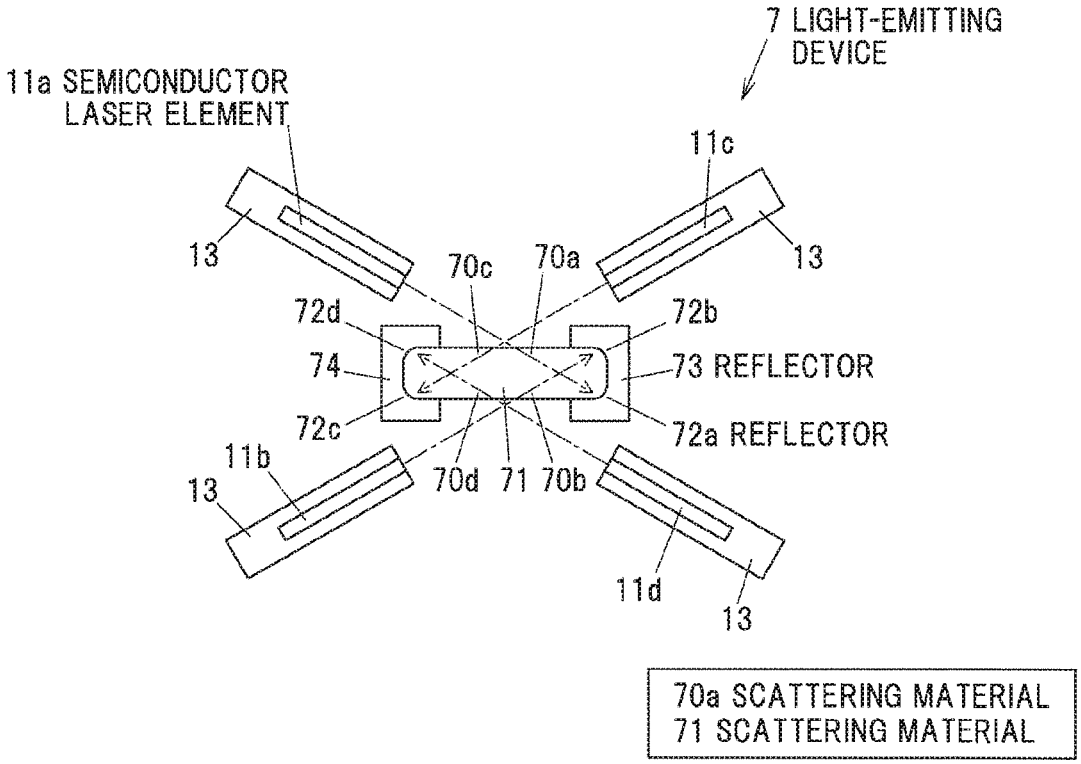

FIGS. 5A and 5B are top views showing internal configurations of light-emitting devices 6 and 7 in the fourth embodiment.

The light-emitting device 6 is provided with the plural semiconductor laser elements 11 (11*a* to 11*d*), plural reflectors 62 (62*a* to 62*d*) each of which reflects light emitted from the corresponding one of the plural semiconductor laser elements 11, and plural scattering materials 60 (60*a* to 60*d*) each of which is arranged between one of the semiconductor laser elements 11 and the corresponding one of the reflectors 62.

The light-emitting device 7 is provided with the plural semiconductor laser elements 11 (11*a* to 11*d*), plural reflectors 72 (72*a* to 72*d*) each of which reflects light emitted from the corresponding one of the plural semiconductor laser elements 11, and plural scattering materials 70 (70*a* to 70*d*) each of which is arranged between one of the semiconductor laser elements 11 and the corresponding one of the reflectors 72.

In the light-emitting devices 6 and 7, light emitted from the plural semiconductor laser elements 11 enters the plural scattering materials 60, 70 and is scattered inside the plural scattering materials 60, 70. Then, light coming out through surfaces on the opposite side to the incidence surfaces is reflected by the plural reflectors 62, 72. Thus, leakage of light is very little, allowing the light-emitting devices 6 and 7 to have high light extraction efficiency.

In the light-emitting device 6, light emitted from the semiconductor laser element 11*a* passes between the reflector 62*c* and the reflectors 62*b*, 62*d* and reaches the reflector 62*a*. Likewise, light emitted from the semiconductor laser element 11*b* passes between the reflector 62*d* and the reflectors 62*a*, 62*c* and reaches the reflector 62*b*. Then, light emitted from the semiconductor laser element 11*c* passes between the reflector 62*a* and the reflectors 62*b*, 62*d* and reaches the reflector 62*c*. Then, light emitted from the semiconductor laser element 11*d* passes between the reflector 62*b* and the reflectors 62*a*, 62*c* and reaches the reflector 62*d*.

Meanwhile, in the light-emitting device 7, light emitted from the semiconductor laser element 11*a* passes between the reflector 72*b* and the reflectors 72*c*, 72*d* and reaches the reflector 72*a*. Likewise, light emitted from the semiconductor laser element 11*b* passes between the reflector 72*a* and the reflectors 72*c*, 72*d* and reaches the reflector 72*b*. Then, light emitted from the semiconductor laser element 11*c* passes between the reflector 72*d* and the reflectors 72*a*, 72*b* and reaches the reflector 72*c*. Then, light emitted from the semiconductor laser element 11*d* passes between the reflector 72*c* and the reflectors 72*a*, 72*b* and reaches the reflector 72*d*.

As such, it is possible to concentrate light emitted from the plural semiconductor laser elements 11 in a very small region by arranging the plural semiconductor laser elements 11 and the plural reflectors 62, 72 so that light emitted from an arbitrary one of the plural semiconductor laser elements 11 reaches the corresponding reflector 62, 72 through a space between two reflectors 62, 72 reflecting light emitted from other semiconductor laser elements 11.

In the light-emitting device 6, the reflectors 62*a* and 62*c* constitute a single continuous reflector 63, and the reflectors 62*b* and 62*d* constitute a single continuous reflector 64. The reflectors 63 and 64 are formed of the same material as the reflector 32 in the second embodiment.

To efficiently reflect light emitted from the semiconductor laser elements 11*a* and 11*c* and incident from different directions, the reflector 63 is configured that a normal line of a reflective surface of a portion serving as the reflector 62*a* is oriented closer to the semiconductor laser element 11*a* than to the semiconductor laser element 11*c*, and a normal line of a reflective surface of a portion serving as the reflector 62*c* is oriented closer to the semiconductor laser element 11*c* than to the semiconductor laser element 11*a*. In addition, the reflector 63 is preferably configured that the reflective surfaces of the portions serving as the reflectors 62*a* and 62*c* are curved, as shown in FIG. 5A.

Likewise, to efficiently reflect light emitted from the semiconductor laser elements 11*b* and 11*d* and incident from different directions, the reflector 64 is configured that a normal line of a reflective surface of a portion serving as the reflector 62*b* is oriented closer to the semiconductor laser element 11*b* than to the semiconductor laser element 11*d*, and a normal line of a reflective surface of a portion serving as the reflector 62*d* is oriented closer to the semiconductor laser element 11*d* than to the semiconductor laser element 11*b*. In addition, the reflector 64 is preferably configured that the reflective surfaces of the portions serving as the reflectors 62*b* and 62*d* are curved, as shown in FIG. 5A.

In the light-emitting device 7, the reflectors 72*a* and 72*b* constitute a single continuous reflector 73, and the reflectors 72*c* and 72*d* constitute a single continuous reflector 74. The reflectors 73 and 74 are formed of the same material as the reflector 32 in the second embodiment.

To efficiently reflect light emitted from the semiconductor laser elements 11*a* and 11*b* and incident from different directions, the reflector 73 is configured that a normal line of a reflective surface of a portion serving as the reflector 72*a* is oriented closer to the semiconductor laser element 11*a* than to the semiconductor laser element 11*b*, and a normal line of a reflective surface of a portion serving as the reflector 72*b* is oriented closer to the semiconductor laser element 11*b* than to the semiconductor laser element 11*a*. In addition, the reflector 73 is preferably configured that the reflective surfaces of the portions serving as the reflectors 72*a* and 72*b* are curved, as shown in FIG. 5B.

Likewise, to efficiently reflect light emitted from the semiconductor laser elements 11*c* and 11*d* and incident from different directions, the reflector 74 is configured that a normal line of a reflective surface of a portion serving as the reflector 72*c* is oriented closer to the semiconductor laser element 11*c* than to the semiconductor laser element 11*d*, and a normal line of a reflective surface of a portion serving as the reflector 72*d* is oriented closer to the semiconductor laser element 11*d* than to the semiconductor laser element 11*c*. In addition, the reflector 74 is preferably configured that the reflective surfaces of the portions serving as the reflectors 72*c* and 72*d* are curved, as shown in FIG. 5B.

In the light-emitting device 6, the scattering material 60*a* is arranged between the semiconductor laser element 11*a* and the reflector 62*a*, the scattering material 60*b* is arranged between the semiconductor laser element 11*b* and the reflector 62*b*, the scattering material 60*c* is arranged between the semiconductor laser element 11*c* and the reflector 62*c*, and the scattering material 60*d* is arranged between the semiconductor laser element 11*d* and the reflector 62*d*.

In the light-emitting device 7, the scattering material 70*a* is arranged between the semiconductor laser element 11*a* and the reflector 72*a*, the scattering material 70*b* is arranged between the semiconductor laser element 11*b* and the reflector 72*b*, the scattering material 70*c* is arranged between the semiconductor laser element 11*c* and the reflector 72*c*, and the scattering material 70*d* is arranged between the semiconductor laser element 11*d* and the reflector 72*d*.

The plural scattering materials 60, 70 are formed of the same materials as the plural scattering materials 20 in the first embodiment. Alternatively, the plural scattering materials 60, 70 may be wavelength-converting members containing a phosphor. In this case, the plural scattering materials 60, 70 are formed of the same materials as the wavelength-converting members used as the scattering materials 20 in the first embodiment.

In case that the plural scattering materials 60, 70 are wavelength-converting members, wavelength-selective reflectors which transmit light emitted from the plural semiconductor laser elements 11 and reflect light wavelength-converted by the plural scattering materials 60, 70, such as DBR films, may be additionally provided on the incidence surfaces of the plural scattering materials 60, 70 on which light emitted from the semiconductor laser elements 11 is incident.

The scattering materials 60*a*, 60*b*, 60*c* and 60*d* may be provided as separate members, but preferably constitute a single continuous scattering material 61 as shown in FIG. 5A. Likewise, the scattering materials 70*a*, 70*b*, 70*c* and 70*d* may be provided as separate members, but preferably constitute a single continuous scattering material 71 as shown in FIG. 5B.

The shape of the plural scattering materials 60, 70 is not specifically limited. In the example shown in FIG. 5A, the scattering material 61 composed of the scattering materials 60*a*, 60*b*, 60*c* and 60*d* has a rectangular prism shape with rounded corners which matches the shape of the reflectors 63 and 64. Likewise, in the example shown in FIG. 5B, the scattering material 71 composed of the scattering materials 70*a*, 70*b*, 70*c* and 70*d* has a rectangular prism shape with rounded corners which matches the shape of the reflectors 73 and 74.

Fifth Embodiment

The fifth embodiment is different from the other embodiments in that light-emitting units each composed of a set of a semiconductor laser element, a reflector and a scattering material, etc., are used. The same members as those in the other embodiments are denoted by the same reference numerals and the explanation thereof will be omitted or simplified. In addition, the explanation of the same features as those in the other embodiments, such as the functions and effects, etc., of the same types of members, will be omitted or simplified.

Configuration of Light-Emitting Device

Figure 6:
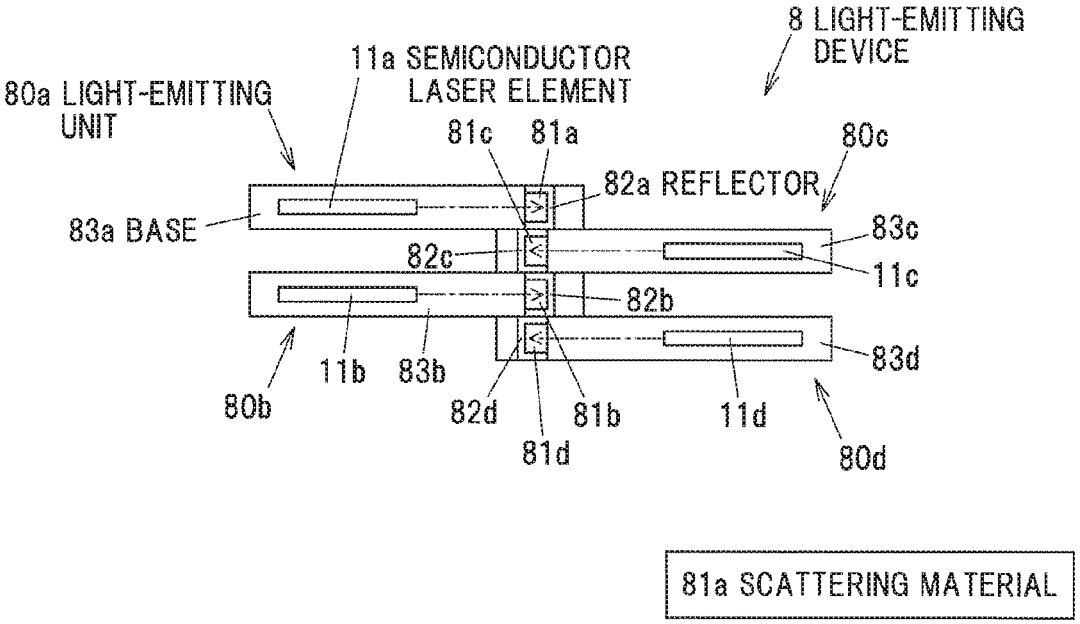
FIG. 6 is a top view showing an internal configuration of a light-emitting device in the fifth embodiment.

FIG. 6 is a top view showing an internal configuration of a light-emitting device 8 in the fifth embodiment.

The light-emitting device 8 is provided with plural light-emitting units 80 (80*a* to 80*d*). The light-emitting unit 80*a* is formed by mounting the semiconductor laser element 11*a*, a scattering material 81*a* and a reflector 82*a* on a base 83*a*. Likewise, the light-emitting units 80*b* to 80*d* are respectively formed by mounting the semiconductor laser elements lib to 11*d*, scattering materials 81*b* to 81*d* and reflectors 82*b* to 82*d* on bases 83*b* to 83*d*.

Each of the plural reflectors 82 (82*a* to 82*d*) reflects light emitted from the corresponding one (11*a*, 11*b*, 11*c* or 11*d*) of the plural semiconductor laser elements 11. Each of the plural scattering materials 81 (81*a* to 81*d*) is arranged between one of the plural semiconductor laser elements 11 and the corresponding one of the plural reflectors 82.

In the light-emitting device 8, light emitted from the plural semiconductor laser elements 11 enters the plural scattering materials 81 and is scattered inside the plural scattering materials 81. Then, light coming out through surfaces on the opposite side to the incidence surfaces is reflected by the plural reflectors 82. Thus, leakage of light is very little, allowing the light-emitting device 8 to have high light extraction efficiency.

In the light-emitting device 8, light emitted from the semiconductor laser element 11*b* passes between the reflectors 82*c* and 82*d* and reaches the reflector 82*b*. Likewise, light emitted from the semiconductor laser element 11*c* passes between the reflectors 82*a* and 82*b* and reaches the reflector 82*c*.

As such, it is possible to concentrate light emitted from the plural semiconductor laser elements 11 in a very small region by arranging the plural light-emitting units 80 so that light emitted from at least one semiconductor laser element 11 reaches the corresponding reflector 82 through a space between two reflectors 82 reflecting light emitted from other semiconductor laser elements 11.

The plural reflectors 82 are reflective films formed on surfaces of the plural scattering materials 81 on the opposite side to the plural semiconductor laser elements 11 and are formed of the same material as the reflector 32 in the second embodiment. To further reduce leakage of light, both side surfaces of the plural scattering materials 81 (surfaces which do not intersect the optical axes of the plural semiconductor laser elements 11) may be also covered with the plural reflectors 82, as shown in FIG. 6.

The scattering material 81*a* is arranged between the semiconductor laser element 11*a* and the reflector 82*a*, the scattering material 81*b* is arranged between the semiconductor laser element 11*b* and the reflector 82*b*, the scattering material 81*c* is arranged between the semiconductor laser element 11*c* and the reflector 82*c*, and the scattering material 81*d* is arranged between the semiconductor laser element 11*d* and the reflector 82*d*.

The plural scattering materials 81 are formed of the same materials as the plural scattering materials 20 in the first embodiment. Alternatively, the plural scattering materials 81 may be wavelength-converting members containing a phosphor. In this case, the plural scattering materials 81 are formed of the same materials as the wavelength-converting members used as the scattering materials 20 in the first embodiment.

In case that the plural scattering materials 81 are wavelength-converting members, wavelength-selective reflectors which transmit light emitted from the plural semiconductor laser elements 11 and reflect light wavelength-converted by the plural scattering materials 81, such as DBR films, may be additionally provided on the incidence surfaces of the plural scattering materials 81 on which light emitted from the semiconductor laser elements 11 is incident.

Effects of the Embodiments

According to the first to fifth embodiments, it is possible to provide a light-emitting device which has high light extraction efficiency and is configured that plural semiconductor laser elements are provided to obtain high output and light emitted from the semiconductor laser elements can be concentrated in a very small region.

Although the embodiments of the invention have been described, the invention is not intended to be limited to the embodiments, and the various kinds of modifications can be implemented without departing from the gist of the invention. In addition, the constituent elements in the embodiments can be arbitrarily combined without departing from the gist of the invention.

In addition, the invention according to claims is not to be limited to the embodiments. Further, please note that all combinations of the features described in the embodiments are not necessary to solve the problem of the invention.

What is claimed is:

1. A light-emitting device, comprising a plurality of semiconductor laser elements including a first semiconductor laser element;

a plurality of reflectors including a first reflector for reflecting light emitted from the first semiconductor laser element, each of reflectors reflecting light emitted from corresponding one of the plurality of semiconductor laser elements; and a plurality of scattering materials that are each arranged in a region between one of the plurality of semiconductor laser elements and corresponding one of the plurality of reflectors, wherein light emitted from the first semiconductor laser element passes through a gap between two of the plurality of reflectors excluding the first reflector and reaches the first reflector, wherein lights emitted from the plurality of semiconductor laser elements are extracted in a direction different than an incident direction thereof toward the plurality of reflectors, wherein each of the plurality of scattering materials comprises a wavelength-converting member, wherein an arbitrary one of the plurality of semiconductor laser elements is defined as a predetermined semiconductor laser element, one of the plurality of reflectors that reflects light emitted from the predetermined semiconductor laser element is defined as a predetermined reflector, and one of the plurality of scattering materials that is arranged between the predetermined semiconductor laser element and the predetermined reflector is defined as a predetermined scattering material, and wherein a wavelength-selective reflector that transmits light emitted from the predetermined semiconductor laser element and reflects light wavelength-converted by the predetermined scattering material is arranged between the predetermined semiconductor laser element and the predetermined scattering material, and between the predetermined reflector and the predetermined scattering material.

2. The light-emitting device according to claim 1, wherein the plurality of scattering materials are integrated into a single scattering material.

3. The light-emitting device according to claim 1, wherein incident directions of lights emitted from the plurality of semiconductor laser elements toward the plurality of reflectors are parallel to each other.

4. The light-emitting device according to claim 1, wherein light emitted from the predetermined semiconductor laser element passes through a gap between two of the plurality of reflectors excluding the predetermined reflector and reaches the predetermined reflector.

5. The light-emitting device according to claim 1, wherein not less than two of the plurality of reflectors are integrated into a single reflector.

* * * * *